US010293892B2

(12) United States Patent
Delanoe et al.

(10) Patent No.: US 10,293,892 B2
(45) Date of Patent: May 21, 2019

(54) SEALED TANK WITH CORRUGATED SEALING MEMBRANES

(71) Applicant: GAZTRANSPORT ET TECHNIGAZ, Saint Remy les Chevreuse (FR)

(72) Inventors: Sebastien Delanoe, Saint Remy les Chevreuse (FR); Francois Durand, Elancourt (FR); Vincent Berger, Bullion (FR); Mohammed Oulalite, Montigny le Bretonneux (FR); Guillaume Le Roux, Les Essarts le Roi (FR)

(73) Assignee: GAZTRANSPORT ET TECHNIGAZ, Saint-Rémy-lès-Chevreuse (FR)

( * ) Notice: Subject to any disclaimer, the term of this patent is extended or adjusted under 35 U.S.C. 154(b) by 17 days.

(21) Appl. No.: 15/484,480

(22) Filed: Apr. 11, 2017

(65) Prior Publication Data

US 2017/0292652 A1 Oct. 12, 2017

(30) Foreign Application Priority Data

Apr. 11, 2016 (FR) ..... 16 53169

(51) Int. Cl.
*B67D 9/02* (2010.01)
*F17C 3/02* (2006.01)
(Continued)

(52) U.S. Cl.
CPC ..... *B63B 25/16* (2013.01); *B67D 9/00* (2013.01); *F17C 3/027* (2013.01); *F17C 3/06* (2013.01);
(Continued)

(58) Field of Classification Search
CPC ..... B63B 25/12; B63B 25/14; B63B 25/16; F17C 3/025; F17C 3/027; F17C 2270/0107; B65D 90/027
See application file for complete search history.

(56) References Cited

U.S. PATENT DOCUMENTS 3,406,858 A * 10/1968 Jackson ..... F17C 3/025 220/560.06
3,547,302 A * 12/1970 Massac ..... B63B 25/16 220/560.08
(Continued)

FOREIGN PATENT DOCUMENTS

WO 2014167228 A2 10/2014

OTHER PUBLICATIONS

Preliminary Search Report (Institut National de la Propriete Industrielle, France) with regard to FR 1653169 dated Jan. 9, 2017.

*Primary Examiner* — Ajay Vasudeva
(74) *Attorney, Agent, or Firm* — Blank Rome LLP

(57) ABSTRACT

The invention concerns a sealed tank including adjacent first and second walls each comprising a corrugated sealing membrane. The sealing membranes of the first and second walls join at the level of an edge, wherein the sealing membrane of the first wall includes a first series of corrugations and a second series of corrugations intersecting at the edge, and the sealing membrane of the second wall includes a third series of corrugations intersecting at the edge. The tank further includes a corner arrangement comprising a sealing membrane that is welded in sealed manner to the sealing membrane of the first wall and to the sealing membrane of the second wall, such that the corrugations of the first series of corrugations are connected to corrugations of the third series of corrugations and the corrugations of the
(Continued)

second series of corrugations are connected to the corrugations of the third series of corrugations.

11 Claims, 5 Drawing Sheets

(51) Int. Cl.

| | |
|---|---|
| ***F17C 3/06*** | (2006.01) |
| ***F17C 5/02*** | (2006.01) |
| ***B63B 25/16*** | (2006.01) |
| ***B67D 9/00*** | (2010.01) |

(52) U.S. Cl.
CPC ..... *F17C 5/02* (2013.01); *F17C 2201/0157* (2013.01); *F17C 2201/052* (2013.01); *F17C 2203/0333* (2013.01); *F17C 2203/0354* (2013.01); *F17C 2203/0358* (2013.01); *F17C 2203/0631* (2013.01); *F17C 2203/0643* (2013.01); *F17C 2203/0646* (2013.01); *F17C 2203/0651* (2013.01); *F17C 2209/221* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2260/011* (2013.01); *F17C 2270/0107* (2013.01)

(56) References Cited

U.S. PATENT DOCUMENTS

| | | | | | |
|---|---|---|---|---|---|
| 3,595,430 | A * | 7/1971 | Massac | F17C 3/027 | 220/560.06 |
| 4,155,482 | A * | 5/1979 | Swaney | B63B 25/16 | 220/560.15 |
| 4,335,831 | A * | 6/1982 | Swaney | B65D 90/06 | 220/560.11 |
| 4,452,162 | A * | 6/1984 | Harbaugh | B63B 25/16 | 114/74 A |
| 7,540,395 | B2 * | 6/2009 | Dhellemmes | B63B 3/68 | 220/608 |
| 2016/0069514 | A1 * | 3/2016 | Delanoe | F17C 3/027 | 137/1 |

* cited by examiner

SEALED TANK WITH CORRUGATED SEALING MEMBRANES

CROSS-REFERENCE

The present application claims priority from French Patent Application No. 1653169 filed on Apr. 11, 2016, the entire content of which is incorporated herein by reference.

TECHNICAL FIELD

The invention relates to the field of sealed tanks.

The invention relates in particular to the field of sealed and thermally insulative tanks intended for storing and/or transporting liquids at low temperature, such as ship tanks for transporting liquefied petroleum gas (LPG) or liquefied natural gas (LNG).

TECHNOLOGICAL BACKGROUND

In the prior art, there are known sealed and thermally insulative tanks intended to be fixed to a supporting structure and comprising a multi-layered structure consisting of one or more sealing membranes and one or more thermal insulation barriers each of which is interleaved between two sealing membranes or between a sealing membrane and the supporting structure.

One such tank is described in the document WO2014167228, for example. In that document, the sealing membrane of each wall of the tank includes a plurality of metal plates featuring series of corrugations perpendicular to one another. The corrugations therefore enable deformation of the sealing membranes because of the effect of thermal and mechanical loads generated by the fluid stored in the tank.

If the tank is mounted in the double hull of a ship, it generally has a polyhedron shape defined by two octagonal end walls connected to each other by a ceiling wall and a bottom wall that are horizontal, two vertical lateral walls, two upper oblique walls each connecting one of the lateral walls to the ceiling wall and two oblique lower walls each connecting one of the lateral walls to the bottom wall. The two series of corrugations of the sealing membrane of the end walls are respectively oriented horizontally and vertically while the two series of corrugations of the sealing membrane of the other walls are respectively oriented in the longitudinal direction of the tank and perpendicularly to the longitudinal direction of the tank.

At the level of each corner of the tank formed at the intersection between two of the eight walls connecting the two end walls and of each corner formed at the intersection between one of the end walls and one of the bottom, ceiling and laterals walls, one of the series of corrugations of each of the two adjacent walls extends in a direction perpendicular to the edge formed at the intersection between two said adjacent walls. The corrugations of the two adjacent walls therefore face one another and the sealing membrane of the corner arrangement features corrugations that assure continuity of the corrugations of the sealing membranes at the level of the corner zone between the two walls. This continuity of the corrugations therefore makes it possible to impart satisfactory flexibility to the sealing membrane at the level of the corner arrangement and to limit stress concentrations in that area.

However, this kind of continuity is not achieved at the level of the intersections between the end walls and the lower or upper oblique walls. In fact, the direction of the vertical corrugations and likewise that of the horizontal corrugations of the sealing member of each end wall are inclined at an angle of 45° relative to the edge formed at the intersection between the end wall and one of the oblique walls while the direction of the corrugations of said oblique wall is perpendicular to the edge. Thus none of the corrugations of the sealing membrane of the end walls is in line with the corrugations of the lower and upper oblique walls. The absence of any such continuity of the corrugations means that the corner arrangements between one of the oblique walls and one of the end walls constitute stress concentration areas and therefore constitute areas of weakness.

SUMMARY

An idea on which the invention is based is to propose a sealed tank of the aforementioned type in which the stress concentrations in the corrugated sealing membranes are limited, in particular at the level of at least one corner zone between two walls joining at the level of an edge that intersects the direction of at least two distinct series of corrugations of the sealing membrane of one of the two walls.

One embodiment of the invention provides a sealed tank including adjacent first and second walls in respective intersecting first and second planes; each of the first and second walls including a corrugated sealing membrane; the sealing membrane of the first wall and the sealing membrane of the second wall joining at the level of an edge;

the sealing membrane of the first wall including a first series of corrugations comprising parallel corrugations extending in a first direction and a second series of corrugations comprising parallel corrugations extending in a second direction intersecting the first direction; the first and second directions intersecting at the edge;

the sealing membrane of the second wall including a third series of corrugations comprising parallel corrugations extending in a third direction intersecting the edge; the tank further including a corner arrangement comprising a sealing membrane welded in sealed manner to the sealing membrane of the first wall and to the sealing membrane of the second wall; the sealing member of the corner arrangement including:

- first corrugation deviation portions each including a corrugation that has a first end in line with one of the corrugations of the first series of corrugations and a second end in line with one of the corrugations of the third series of corrugations; and
- second corrugation deviation portions each including a corrugation that has a first end in line with one of the corrugations of the second series of corrugations and a second end in line with one of the corrugations of the third series of corrugations; the first corrugation deviation portions being interleaved with the second corrugation deviation portions along the corner arrangement.

Accordingly, thanks to the presence of the aforementioned corrugation deviation portions, continuity of the corrugations is assured at the level of the corner between the first and second walls, even though the first and second series of corrugations intersect the edge. The stress concentrations in the corner zone are therefore limited.

According to other advantageous embodiments, a tank of this kind can have one or more of the following features.

According to one embodiment, each first or second corrugation deviation portion includes:

at least one corner piece portion comprising two flanges respectively parallel to one and the other of the first and second planes, said corner piece portion including a corrugation portion in line with one of the corrugations of the third series of corrugations, from one end to the other of the corner piece portion, along the two flanges; and a junction piece including a bent corrugation portion connecting the corrugation portion of the corner piece portion to one of the corrugations of the first or second series of corrugations.

According to one embodiment, each of the corrugations of the first and second series of corrugations that intersects the edge is extended by one of the first or second corrugation deviation portions.

According to one embodiment, the first direction in which the corrugations of the first series of corrugations extend and the second direction in which the corrugations of the second series of corrugations extend are mutually perpendicular.

According to one embodiment, the corrugations of the first series of corrugations and the corrugations of the second series of corrugations are spaced by the same inter-corrugation distance x.

According to one embodiment, the corrugations of the third series of corrugations are spaced by a constant inter-corrugation distance y.

According to one embodiment:

the corrugations of the third series of corrugations that are connected to the first deviation portions are spaced from one another by a distance z1 equal to n1*y where n1 is an integer greater than 1;

the corrugations of the third series of corrugations that are connected to the second deviation portions are spaced from one another by a distance z2 equal to n2*y where n2 is an integer greater than 1; and the angle θ between the edge and the first direction satisfies the equation:

$$\theta = \tan^{-1}\frac{n2}{n1}$$

According to one embodiment, the inter-corrugation distance y between two corrugations of the third series of corrugations satisfies the following formula:

$$\frac{x}{y} = \frac{n1 * n2}{\sqrt{n1^2 + n2^2}}$$

According to one embodiment, the angle θ between the edge and the first direction is 45°.

According to other embodiments, the corrugations of the third series of corrugations are distributed along the edge at a first inter-corrugation distance y1 and a second inter-corrugation distance y2, the first and second inter-corrugation distances y1 and y2 being such that the corrugations of the first series of corrugations and the corrugations of the second series of corrugations are spaced by the same inter-corrugation distance x.

The third direction is advantageously perpendicular to the edge.

According to one embodiment, the tank has two end walls connected to each other by walls extending in the longitudinal direction of the tank and in which the first wall forms one of the two end walls and the second wall forms one of the walls extending in the longitudinal direction of the tank.

According to one embodiment, the sealing membrane of the second wall includes a fourth series of corrugations comprising corrugations extending in directions parallel to the intersection between the first and second walls.

According to one embodiment, each wall of the tank includes a thermally insulative barrier anchored to a supporting structure and to which the sealing membrane of the corresponding wall is anchored.

A tank of this kind can form part of a land storage installation, for example for storing LNG, or be installed in a floating structure, for coastal or deep waters, notably an ethane or methane tanker ship, a floating storage and regasification unit (FSRU), a floating production storage and offloading unit (FPSO), etc. In the case of a floating structure, the tank can be intended to receive liquefied natural gas used as fuel for the propulsion of the floating structure.

According to one embodiment, a ship for transporting a fluid includes a hull, such as a double hull, and an aforementioned tank disposed in the hull.

According to one embodiment, the invention also provides a method of loading or offloading a ship of this kind in which a fluid is routed through insulated pipes from or to a floating or land storage installation to or from the tank of the ship.

One embodiment of the invention also provides a system for transferring a fluid, the system including the aforementioned ship, insulated pipes adapted to connect the tank installed in the hull of the ship to a floating or land storage installation and a pump for driving a flow of fluid through the insulated pipes from or to the floating or land storage installation to or from the tank of the ship.

BRIEF DESCRIPTION OF THE FIGURES

The invention will be better understood and other objects, details, features and advantages thereof will become more clearly apparent in the light of the following description of particular embodiments of the invention provided by way of nonlimiting illustration only and with reference to the appended drawings.

DETAILED DESCRIPTION OF EMBODIMENTS

Figure 1:
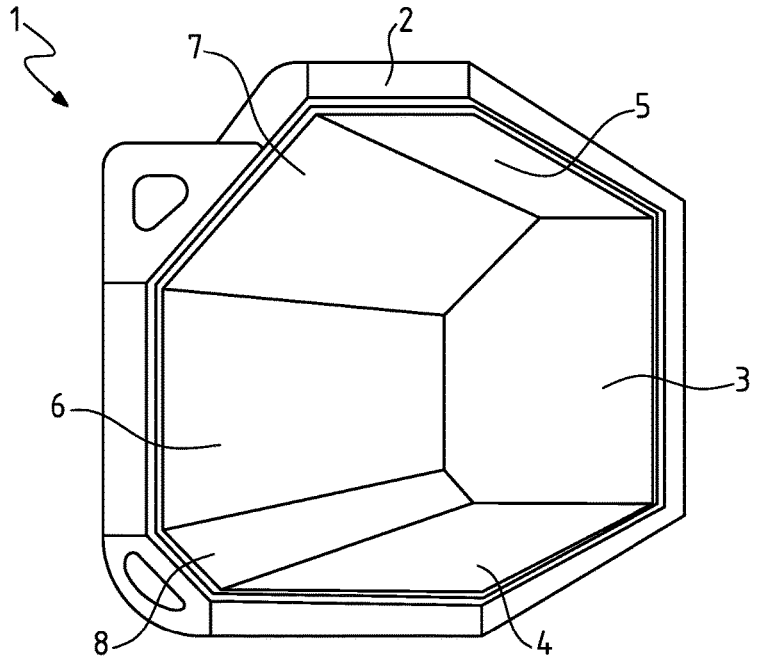
FIG. 1 is a partial sectional perspective view of a tank.
Figure 2:
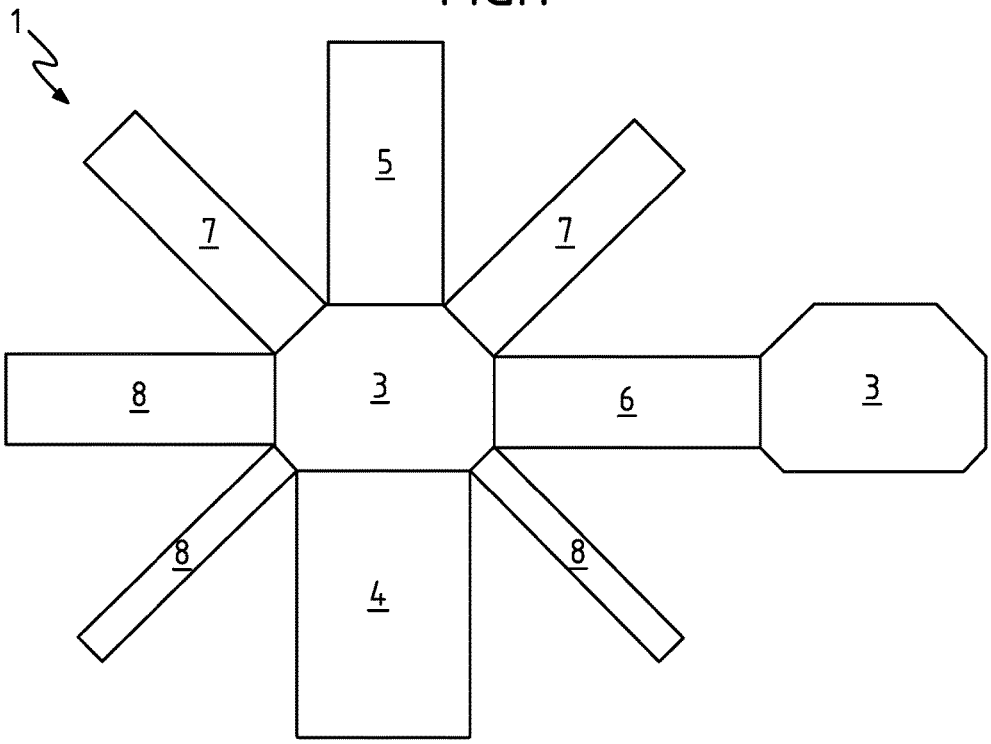
FIG. 2 shows the tank from FIG. 1 flattened out.

FIGS. 1 and 2 show the general structure of a tank 1.

The tank 1 is mounted on a supporting structure 2. The supporting structure 2 can in particular be a self-supporting metal plate or more generally any type of rigid bulkhead having appropriate mechanical properties. The supporting structure includes a plurality of walls defining the general shape of the tank 1. In the embodiment described hereinafter, the supporting structure 2 is formed by the double hull of a ship.

The tank 1 has a polyhedral general shape. It has two octagonal end walls 3. The end walls 3 are fixed to transverse coffer dam bulkheads of the ship and consequently extend perpendicularly to the longitudinal direction of the ship. The two end walls 3 are connected to each other by eight walls extending in the longitudinal direction of the ship, namely:

- a bottom wall 4 and a ceiling wall 5 that are horizontal;
- two lateral walls 6 that are vertical;
- two upper oblique walls 7 that each connect one of the laterals 6 to the ceiling wall 5; and
- two lower oblique walls 8 that each connect one of the lateral walls 6 to the bottom wall 4.

The lower oblique walls 8 are at an angle of 135° to the bottom wall 4 and an angle of 135° to the lateral walls 6. Similarly, the upper oblique walls 7 are at an angle of 135° to the ceiling wall 5 and an angle of 135° to the lateral walls 6.

Figure 3:
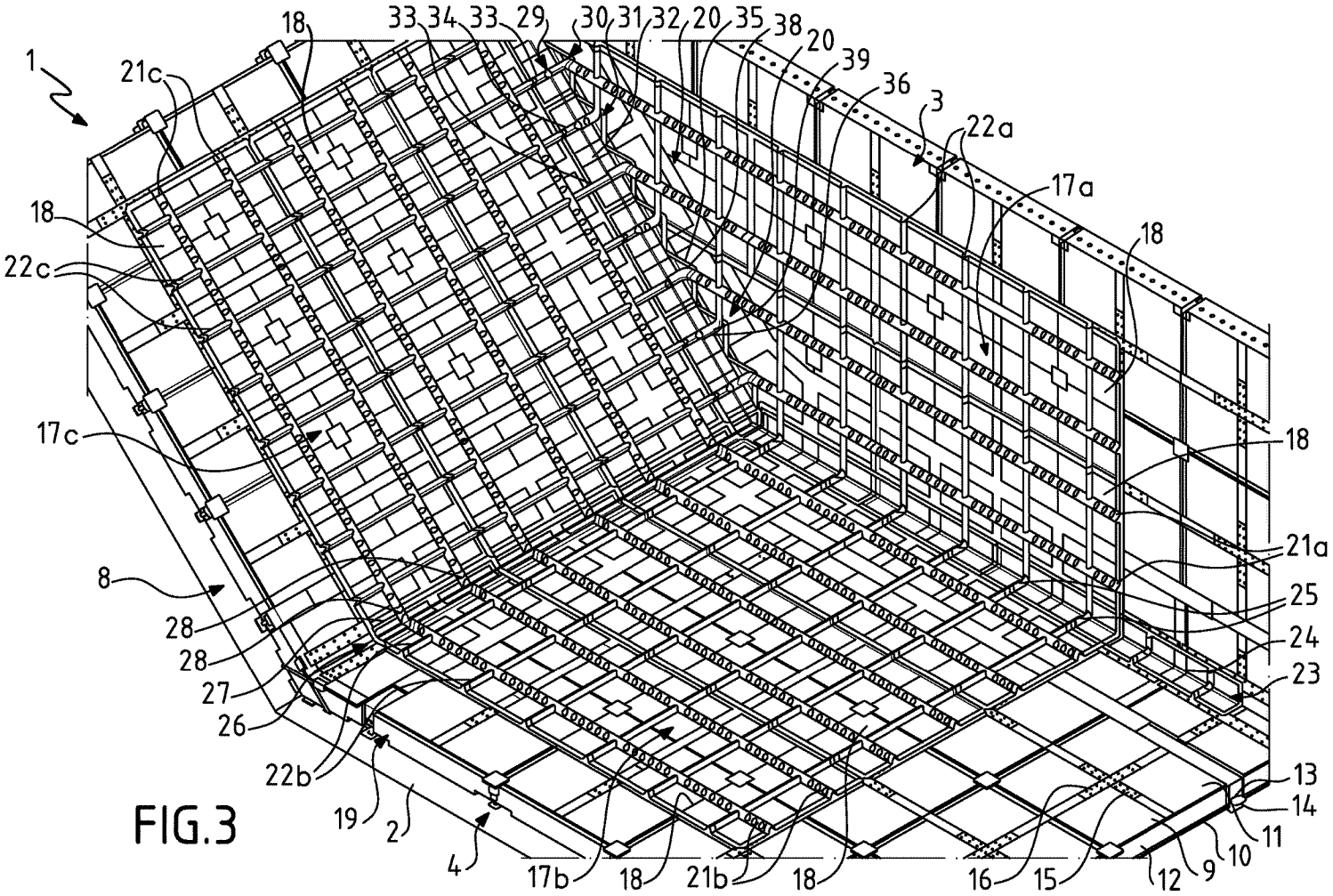
FIG. 3 is a cutaway perspective view of an area of a tank at the intersection between an end wall, a bottom wall and a lower oblique wall.

The structure of a tank 1 according to a first embodiment is seen in FIG. 3 in an area where one of the end walls 3, the bottom wall 4 and one of the lower oblique walls 8 join.

Each wall 3, 4, 8 of the tank 1 includes a thermally insulative barrier 19 that is anchored to the corresponding wall of the supporting structure 2. Each thermally insulative barrier 19 consists of a plurality of heat insulation elements 9 that are anchored to the supporting structure 2. The heat insulating elements 9 are juxtaposed to one another in parallel rows. The heat insulating elements 9 have a parallelepipedal general shape except for the heat insulating elements, not shown, of the end wall 3 that extend along an intersection with one of the upper oblique walls 7 or lower oblique walls 8. In fact, these heat insulating elements have a right-angle trapezium or right-angle triangle general shape so as to match the octagonal shape of the end walls 3. The heat insulating elements 9 conjointly form a plane surface to which the sealing membrane 17*a*, 17*b*, 17*c* of the corresponding wall 3, 4, 8 is anchored.

In the embodiment shown, each heat insulating element 9 includes a bottom panel 10 and a cover panel 11 that are parallel. Each heat insulating element 9 includes four side panels 12 that extend perpendicularly to the bottom panel 10 and the cover panel 11 and define an internal space. Moreover, a plurality of spacers, not visible in FIG. 3, upstanding in the direction of the thickness of the tank 1 are disposed between the bottom panel 10 and the cover panel 11, perpendicularly to them. The bottom panel 10, the cover panel 11, the side panels 12 and the spacers are made of plywood, for example. Moreover, the compartments formed between the spacers are lined with a heat insulating lining, not shown, such as perlite or glass wool, for example.

The heat insulating elements 9 are anchored to the supporting wall by means of beads of resin, not shown, and/or studs 13 welded to the supporting structure 2. According to one embodiment, the studs 13 project toward the interior of the tank 1 in the interstices formed between the heat insulating elements 9. The studs 13 are threaded and cooperate with a nut that retains a bearing member 14 threaded onto the stud 13. The bearing member 14 is pressed against a projecting part of the adjacent heat insulating elements 9 so as to hold them against the supporting structure 2.

Each heat insulating element 9 is equipped with metal plates 15, 16 for anchoring the edge of the corrugated metal plates 18 of the sealing membranes 17*a*, 17*b*, 17*c*. The metal plates 15, 16 extend in two perpendicular directions each of which is parallel to two opposite sides of the heat insulating element 9. The metal plates 15, 16 are fixed to the cover panel 9 by screws, rivets or staples, for example. The metal plates 15, 16 are positioned in spaces formed on the internal surface of the cover panels 11 so that the internal surface of the metal plates 15, 16 is flush with the internal surface of the cover panels 11.

Each wall 3, 4, 8 of the tank 2 is moreover equipped with a sealing membrane 17*a*, 17*b*, 17*c* comprising a plurality of corrugated metal plates 18. The corrugated metal plates 18 can notably be made of stainless steel, aluminium, Invar®, that is to say an alloy of iron and nickel the coefficient expansion of which is typically between $1.2\times10^{-6}$ and $2\times10^{-6}\ K^{-1}$ inclusive, or an iron alloy with a high manganese content, the coefficient of expansion of which is typically of the order of $7\times10^{-6}\ K^{-1}$.

The corrugated metal plates 18 are on the one hand welded to one another so that they overlap and in a sealed manner and on the other hand welded to the metal plates 15, 16 so as to anchor the sealing membrane 17*a*, 17*b*, 17*c* to the thermally insulating barrier 19.

Most of the corrugated metal plates 18 have a substantially rectangular shape. However, the corrugated metal plates 20 of the end walls 3 that extend along the corner formed with one of the lower oblique walls 8 or upper oblique walls have a right-angle trapezium or right-angle triangle general shape so as to match the octagonal shape of the end walls 3. The edge of these corrugated metal plates 20 that extends along the apex of the corner formed with the oblique wall 8 has a crenelated shape.

Each sealing membrane 17*a*, 17*b*, 17*c* includes two series of corrugations 21*a*, 22*a*; 21*b*, 22*b*; 21*c*, 22*c* each comprising parallel corrugations. The directions of the two series of corrugations of each sealing membrane 17*a*, 17*b*, 17*c* are mutually perpendicular. The two series of corrugations 21*a*, 22*a* of the sealing membrane 17*a* of the end walls 3 are respectively oriented horizontally and vertically. The two series of corrugations 22*b* and 21*b* of the sealing membrane 17*b* of the bottom wall 4 are oriented in the longitudinal direction of the tank 1 and perpendicularly to said longitudinal direction. The two series of corrugations 22*c* and 21*c* of the sealing membrane 17*c* of the oblique wall 8 are also oriented in the longitudinal direction of the tank 1 and perpendicularly to said longitudinal direction.

The corner arrangement 23 disposed at the intersection between the bottom wall 4 and the end wall 3 includes a sealing membrane that consists of a plurality of metal corner pieces 24. Each corner piece 24 includes two flanges that are parallel to the end wall 3 and the bottom wall 4, respectively. The edges of one of the two flanges are anchored to metal plates 15, 16 carried by heat insulating elements 9 of the end wall 3 whereas the edges of the other flange are anchored to metal plates 15, 16 carried by heat insulating elements 9 of the bottom wall 4. Moreover, the adjacent corner pieces 24 are welded together so that they overlap one another. The corner pieces 24 are moreover welded so that they overlap on the one hand the adjacent metal plates 18 of the end wall 3 and on the other hand the adjacent metal plates 18 of the bottom wall 4 so as to produce a sealed junction between the sealing membranes 17*a*, 17*b* of the end wall 3 and the bottom wall 4.

Moreover, each corner piece 24 includes one or more corrugations 25, two of them in the embodiment shown, that extend from one end to the other of the corner piece 24 along the two flanges so as to enable deformation of the corner piece 24 in a direction parallel to the edge formed at the intersection of the bottom wall 4 and the end wall 3.

Each corrugation 25 of the corner piece 24 is on the one hand in line with one of the corrugations 22*b* of the bottom wall 4 and on the other hand in line with one of the vertical corrugations 22*a* of the end wall 3. Accordingly, continuity of the corrugations 22*a*, 22*b* making it possible to limit stress concentrations is assured at the level of the intersection of the bottom wall 4 and the end wall 3.

Note that all the other corner arrangements at the intersection between one of the end walls 3 and the bottom wall 4 or the ceiling wall 5 have an identical arrangement. Moreover, the corner arrangements at the intersection between one of the end walls 3 and one of the lateral walls 6 are similar, the only difference being that each of the corrugations 25 of the corner pieces 24 is in line with one of the horizontal corrugations 21*a* of the end wall and not one of the vertical corrugations 21*b*.

Moreover, the corner arrangement 26 at the intersection between the bottom wall 4 and the lower oblique wall 8 has a similar arrangement, the corner pieces 27 of a corner arrangement 26 of this kind differing from the corner pieces 24 described above only in that the angle between the two flanges of the corner pieces 27 is not 90° but 135°. The corner pieces 27 therefore include corrugations 28 each of which is on the one hand in line with one of the corrugations 21*b* of the bottom wall 4 and on the other hand in line with one of the corrugations 21*c* of the lower oblique wall 8. Note that all the other corner arrangements at the intersection between two of the eight walls 4, 5, 6, 7, 8 connecting the two end walls 3 have a similar arrangement.

For its part, each corner arrangement 29 at the intersection between one of the end walls 3 and one of the upper oblique walls 7 or lower oblique walls 8 has a structure significantly different from the corner arrangements described above. In fact, as shown in FIG. 3, the corner arrangement 29 at the intersection between the lower oblique wall 8 and the end wall 3 includes a sealing membrane that is adapted to connect the corrugations 22*c* of the lower oblique wall 8 alternately to a vertical corrugation 22*a* and a horizontal corrugation 21*a* of the end wall 3.

To this end, the sealing membrane of the corner arrangement 29 comprises first corrugation deviation portions 30 that enable each of them to connect one of the corrugations 22*c* of the oblique wall 8 to one of the horizontal corrugations 21*a* of the end wall 3 and second corrugation deviation portions 31 that enable each of them to connect one of the corrugations 22*c* of the oblique wall 8 to one of the vertical corrugations 22*a* of the end wall 3.

The corner arrangement 29 more particularly includes a plurality of corner pieces 32. Each corner piece 32 includes two flanges that are respectively parallel to the end wall 3 and to the oblique wall 8. The edges of one of the two flanges are anchored to metal plates 15, 16 carried by heat insulating elements 9 of the end wall 3 and the edges of the other flange are anchored to metal plates 15, 16 carried by heat insulating elements 9 of the lower oblique wall 8. Moreover, the adjacent corners 32 are welded together so that they overlap one another. The corner pieces 32 are moreover welded so that they overlap on the one hand the adjacent metal plates 20 of the end wall 3 and on the other hand the adjacent metal plates 18 of the oblique wall 8 so as to assure a sealed joint between the sealing membranes 17*a*, 17*b* of the lower oblique wall 8 and the end wall 3.

Each corner piece 32 includes one or more corrugation portions 33, 34, two of them in the embodiment shown, that extend from one end to the other of the corner piece 32 along the two flanges so as to allow deformation of the corner piece 32 in a direction parallel to the edge formed at the intersection of the end wall 3 and the lower oblique wall 8.

Each corrugation portion 33, 34 of the angle part 32 is in line with one of the corrugations 22*c* of the lower oblique wall 8.

Moreover, the corner arrangement 29 includes triangular metal joining pieces 35, 36 each of which is welded so that they overlap one of the corner pieces 32 and one of the metal plates 20 of the end wall 3 extending along the corner formed with the oblique wall 8. Each of these joining pieces 35, 36 includes a bent corrugation portion 38, 39, here bent at 145°, one of the ends of which is connected to one of the corrugation portions 33, 34 of the corner piece 32 and the other end of which is connected either to one of the horizontal corrugations 21*a* of the end wall 3 or to one of its vertical corrugations 22*a*. The bent corrugation portions 38, 39 are oriented in one direction or the other according to whether they are to be connected to one of the horizontal corrugations 21*a* or to one of the vertical corrugations 22*a* of the end wall 3.

Accordingly, in the embodiment shown, each of the first and second deviation portions 30, 31 is formed by a portion of a corner piece 32 and a joining piece 35, 36.

The inter-corrugation distance between the horizontal corrugations 21*a* of the end wall 3 is equal to the inter-corrugation distance between the vertical corrugations 22*a* of the end wall 3. This inter-corrugation distance between the corrugations 21*a*, 22*a* of the end wall is denoted x hereinafter.

Moreover, the inter-corrugation distance between the corrugations 22*b* of the bottom wall extending in the longitudinal direction of the tank and between the longitudinal corrugations of the ceiling wall 5 and the lateral wall 6 is equal to the aforementioned inter-corrugation distance x.

Also, in order to assure a match between the corrugations 22*c* of the lower oblique wall 8 and the horizontal and vertical corrugations 21*a*, 22*a* of the end wall 3, the inter-corrugation distance y of the corrugations 22*c* of the lower oblique wall 8 and the inter-corrugation distance x between the horizontal corrugations 21*a* and the vertical corrugations 22*a* of the end wall 3 are determined by the method described below with reference to FIG. 4.

Figure 4:
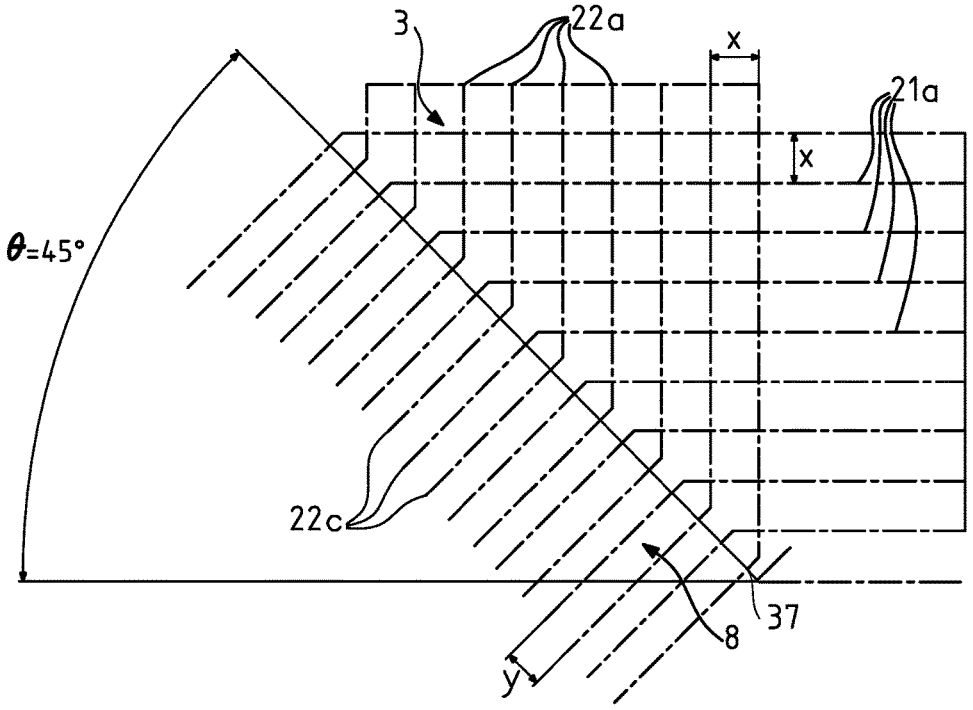
FIG. 4 is a diagram showing an area of the flattened out tank at the junction between an end wall and an oblique wall and in a first embodiment.

FIG. 4 is a diagram showing the flattened out tank at the junction between the end wall 3 and the oblique wall 8. It corresponds to the embodiment from FIG. 1 in which the edge 37 formed at the intersection between the end wall 3 and the lower oblique wall 8 is inclined at an angle θ of 45° to the horizontal. In other words, the horizontal corrugations 21*a* of the end wall 3 are also inclined at an angle 45° to the edge 37 formed at the intersection between the end wall 3 and the lower oblique wall 8.

In order to assure an adequate match between the corrugations 21*a*, 22*a*, 22*c*, the inter-corrugation distance y is determined as a function of the following formula:

$$y = \frac{x}{\sqrt{2}}.$$

For example, for a tank intended to contain liquefied petroleum gas stored at a temperature between −50° C. and 0° C. inclusive, the inter-corrugation distance x is of the order of 600 mm and the inter-corrugation distance y is therefore 424.3 mm. According to another example, for a tank intended to contain liquefied natural gas that is stored at atmospheric pressure at −163° C., the inter-corrugation distance x is smaller, given the lower storage temperature, and is of the order of 340 mm, for example. In this case, the inter-corrugation distance y is 240.4 mm.

Referring to FIGS. 5 to 8, there are seen other diagrams showing a flattened out tank at the junction between the end wall 3 and a lower oblique wall 8 when the tank has some other general shape and the horizontal corrugations 21*a* of the end wall 3 are therefore inclined at an angle θ different from 45° relative to the edge 37 formed between the end wall 3 and the lower oblique wall 8.

Give that, for these embodiments, the inter-corrugation distance y remains constant between the corrugations 22*c* of the lower oblique wall 8 and the inter-corrugation distances x between the horizontal corrugations and between the vertical corrugations of the end wall are equal, only some of the corrugations 22*c* of the lower oblique wall 8 that intersect the edge 37 are connected to the corrugations 21*a*, 22*a* of the end wall 3 while the remaining corrugations 22*c* of the lower oblique wall 8 are interrupted before the edge 37.

Accordingly, the corrugations 22*c* of the lower oblique wall 8 that are connected to the horizontal corrugations 22*a* are spaced from one another by a distance z1 equal to n1 times the inter-corrugation distance y where n1 is an integer greater than 1 and the corrugations 22*c* of the lower oblique wall 8 that are connected to the vertical corrugations are spaced from one another by a distance z2 equal to n2 times the inter-corrugation distance y where n2 is an integer greater than 1.

In order for a corresponding solution to exist, the angle θ formed between the edge 37 and the horizontal corrugations 21*a* must satisfy the following formula:

$$\theta = \tan^{-1}\frac{n2}{n1};$$

and

The ratio between the inter-corrugation distances x and y is defined by the aforementioned formula, namely:

$$\frac{x}{y} = \frac{n1 * n2}{\sqrt{n1^2 + n2^2}}$$

or by the equivalent formula $$y = \frac{x}{2 * \cos\theta}$$

It will be noted that the situation from FIG. 4 with an angle of 45° also satisfies these formulas with n1=n2=2.

Figure 5:
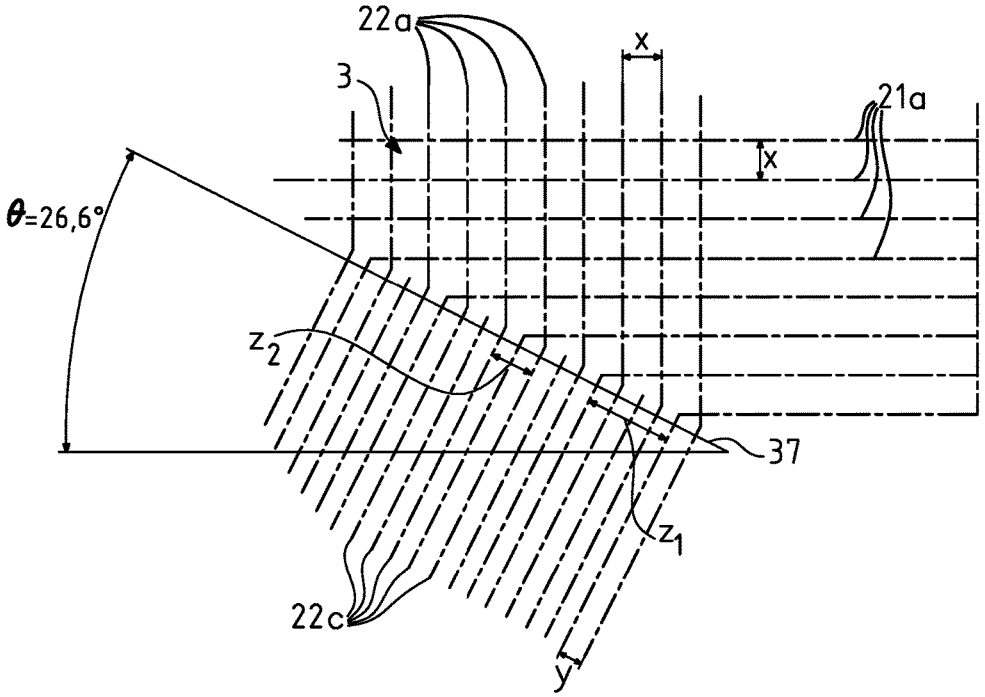
FIG. 5 is a view analogous to that of FIG. 4 corresponding to a second embodiment.

FIG. 5 corresponds to a second embodiment in which the angle θ is 26.6°, which corresponds to variables n1 and n2 respectively equal to 4 and 2. By way of example, for an inter-corrugation distance x of 600 mm, the inter-corrugation distance y is therefore 335.4 mm.

Figure 6:
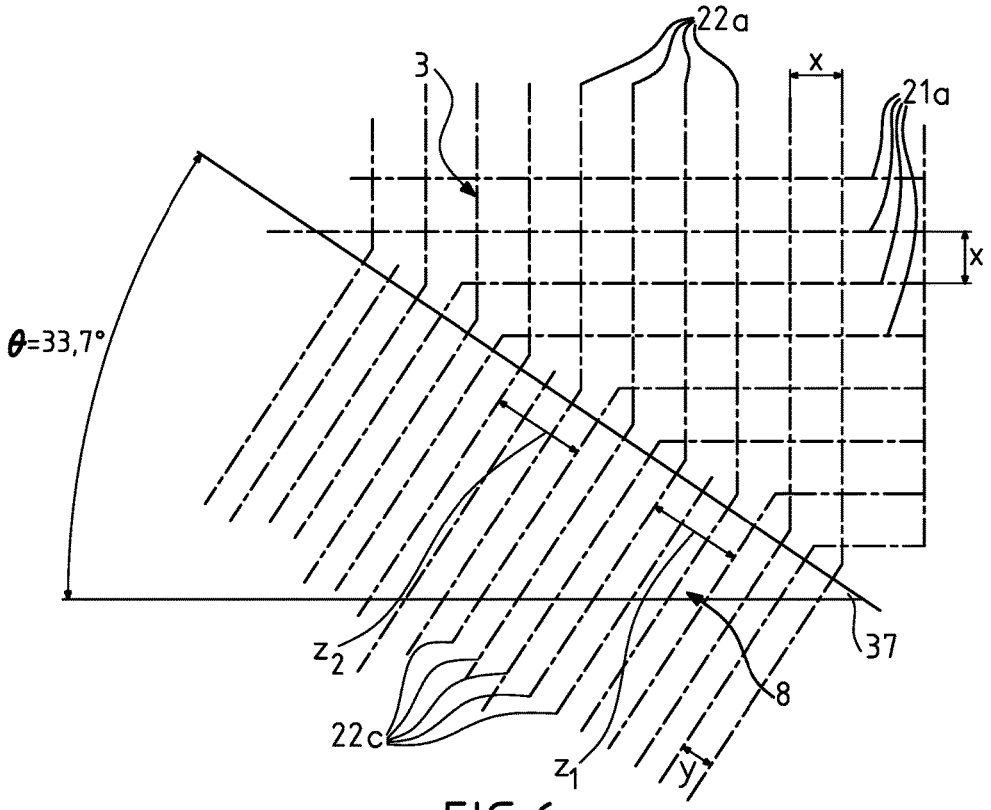
FIG. 6 is a view analogous to that of FIG. 4 corresponding to a third embodiment.

FIG. 6 corresponds to a third embodiment in which the angle θ is 33.7°, which corresponds to variables n1 and n2 respectively equal to 3 and 2. For example, for an inter-corrugation distance x of 600 mm, the inter-corrugation distance y is 360.6 mm.

Figure 7:
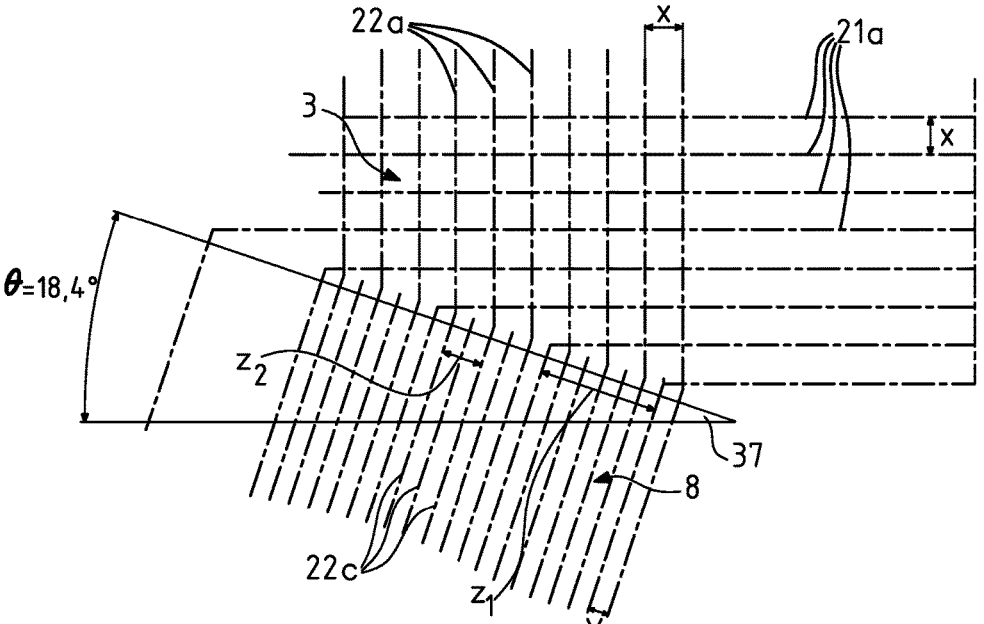
FIG. 7 is a view analogous to that of FIG. 4 corresponding to a fourth embodiment.

FIG. 7 corresponds to a fourth embodiment in which the angle θ is 18.4°, which corresponds to variables n1 and n2 respectively equal to 6 and 2. For example, for an inter-corrugation distance x of 600 mm, the inter-corrugation distance y is 316.2 mm.

Figure 8:
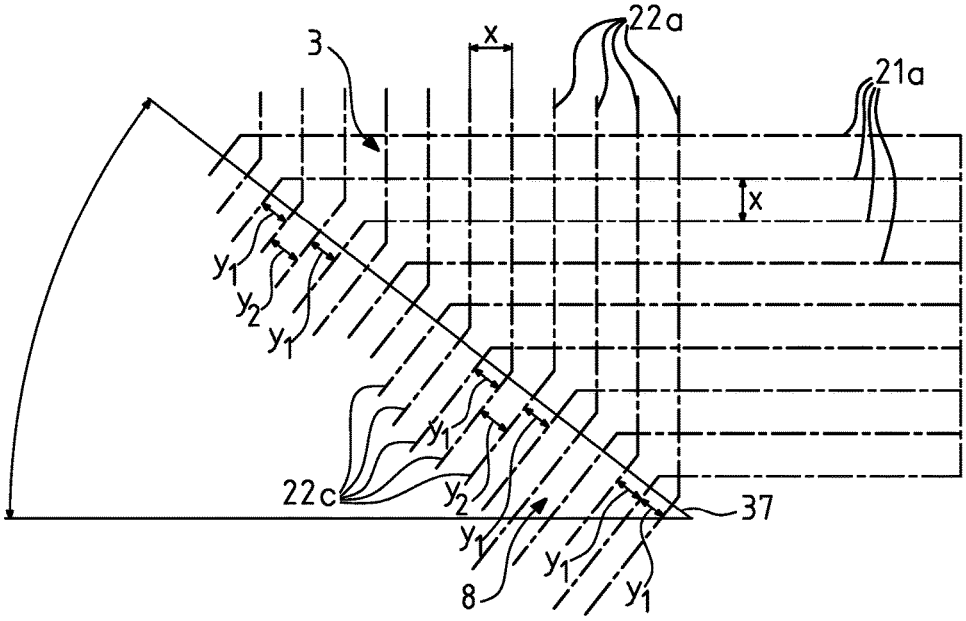
FIG. 8 is a view analogous to that of FIG. 4 corresponding to a fifth embodiment.

FIG. 8 is a diagram showing a fifth embodiment of a flattened out tank at the junction between the end wall 3 and the lower oblique wall 8 when the horizontal corrugations 21*a* of the end wall 3 are inclined relative to the edge 27 at an angle θ which on the one hand is different from 45° and on the other hand does not satisfy the formula $$\cdot\theta = \tan^{-1}\frac{n2}{n1}$$

In an embodiment of this kind, in order to assure a match between the corrugations 22*c* of the lower oblique wall 8 and those of the end wall 3, the inter-corrugation distance between the corrugations 22*c* of the lower oblique wall 8 is not kept constant and varies periodically. Accordingly, in FIG. 8, the corrugations of the oblique wall are spaced either by an inter-corrugation distance y1 or by an inter-corrugation distance y2.

Although the invention is described above at the level of the intersection between the lower oblique wall 8 and an end wall 3 of a polyhedral tank of octagonal section, it is clear that it is in no way limited thereto and that the invention can apply more generally to any corner of a tank between two walls of the tank.

Note further that the tank can have a shape different from that shown in FIGS. 1 and 2. In particular, the tank may be intended to be integrated into the bow of a ship. In this case, it is possible for the bottom wall and/or the ceiling wall to have a trapezoidal shape the section of which decreases toward the bow of the ship, notably as represented diagrammatically in FIG. 1 of the document FR2826630. It is equally possible for each of the lower and upper oblique walls to have a pentagonal shape the section of which decreases toward the bow of the ship so that each upper oblique wall is therefore connected to a lower oblique wall by two lateral walls.

The technique described above for producing a sealing membrane can be used in different types of tanks.

Figure 9:
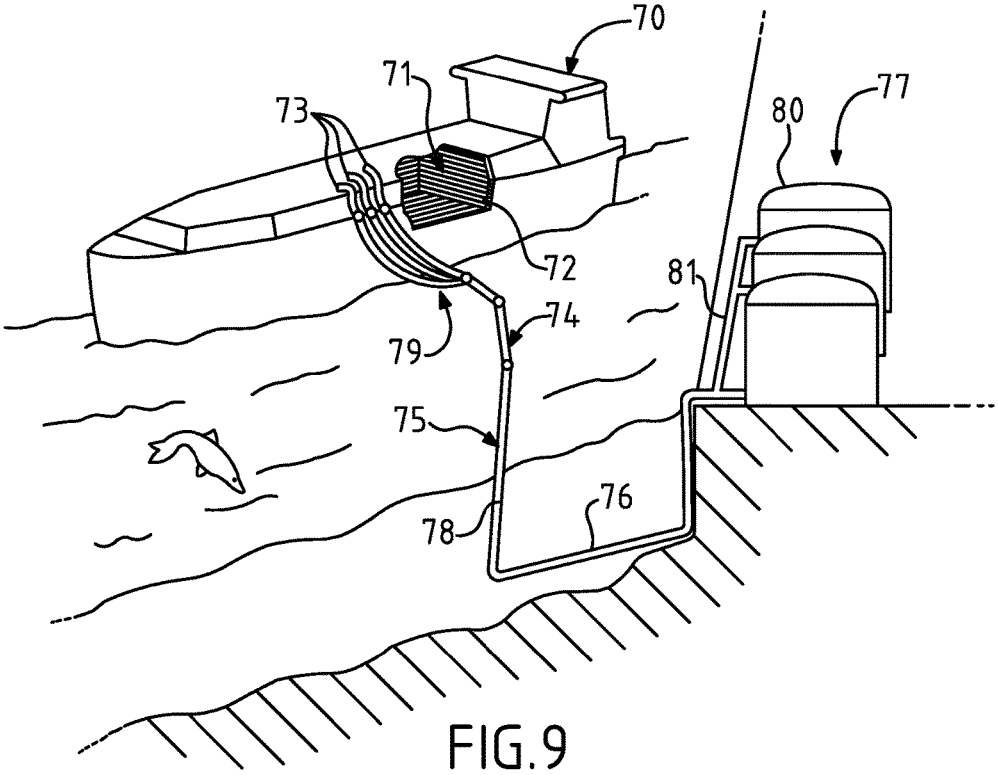
FIG. 9 is a diagrammatic cutaway view of a methane tanker ship tank and a terminal for loading/offloading said tank.

Referring to FIG. 9, a cutaway view of a methane tanker ship 70 shows a sealed and insulated tank 71 of prismatic general shape mounted in the double hull 72 of the ship. The wall of the tank 71 includes a primary sealed barrier intended to be in contact with the LNG contained in the tank, a secondary sealed barrier between the primary sealed barrier and the double hull 72 of the ship, and two insulative barriers between the primary sealed barrier and the secondary sealed barrier and between the secondary sealed barrier and the double hull 72, respectively.

In a manner known in itself, loading/offloading pipes 73 on the upper deck of the ship can be connected by means of appropriate connectors to an offshore or harbour terminal to transfer a cargo of LNG from or to the tank 71.

FIG. 9 shows an example of an offshore terminal including a loading and offloading station 75, an underwater pipe 76 and a land installation 77. The loading and offloading station 75 is a fixed offshore installation including a mobile arm 74 and a tower 78 that supports the mobile arm 74. The mobile arm 74 carries a bundle of insulated flexible tubes 79 that can be connected to the loading/offloading pipes 73. The orientable mobile arm 74 adapts to all methane tanker sizes. There is a connecting pipe that is not shown inside the tower 78. The loading and offloading station 75 makes it possible to load or to offload the methane tanker 70 from or to the land installation 77. The latter includes liquefied gas storage tanks 80 and connecting pipes 81 connected by the underwater pipe 76 to the loading or offloading station 75. The underwater pipe 76 enables the transfer of the liquefied gas between the loading or offloading station 75 and the land installation 77 over a great distance, for example 5 km, which enables the methane tanker ship 70 to remain at a great distance from the coast during loading and offloading operations.

Onboard pumps on the ship 70 and/or pumps of the land installation 77 and/or pumps of the loading and offloading station 75 are used generate the pressure necessary for transferring the liquefied gas.

Although the invention has been described with reference to a plurality of particular embodiments, it is clear that it is no way limited to them and that it encompasses all technical equivalents of the means described and combinations thereof within the scope of the invention.

The use of the verb "include" or "comprise" and conjugate forms thereof does not exclude the presence of elements or steps other than those stated in a claim.

In the claims, any reference sign between parentheses should not be interpreted as a limitation of the claim.

The invention claimed is:

1. A sealed tank comprising:

adjacent first and second walls in respective intersecting first and second planes; each of the first and second walls including a corrugated sealing membrane; the sealing membrane of the first wall and the sealing membrane of the second wall joining at the level of an edge; the sealing membrane of the first wall including a first series of corrugations comprising parallel corrugations extending in a first direction and a second series of corrugations comprising parallel corrugations extending in a second direction intersecting the first direction; the first and second directions intersecting at the edge; the first direction in which the corrugations of the first series of corrugations extend and the second direction in which the corrugations of the second series of corrugations extend are perpendicular; the corrugations of the first series of corrugations and the corrugations of the second series of corrugations are spaced by the same inter-corrugation distance x; and the sealing membrane of the second wall including a third series of corrugations comprising parallel corrugations extending in a third direction intersecting the edge; the corrugations of the third series of corrugations being spaced by a constant inter-corrugation distance y;

the tank further comprising a corner arrangement comprising a sealing membrane welded in a sealed manner to the sealing membrane of the first wall and to the sealing membrane of the second wall; the sealing member of the corner arrangement including:

first corrugation deviation portions each including a corrugation that has a first end in line with one of the corrugations of the first series of corrugations and a second end in line with one of the corrugations of the third series of corrugations; and second corrugation deviation portions each including a corrugation that has a first end in line with one of the corrugations of the second series of corrugations and a second end in line with one of the corrugations of the third series of corrugations;

the first corrugation deviation portions being interleaved with the second corrugation deviation portions along the corner arrangement;

wherein the corrugations of the third series of corrugations that are connected to the first deviation portions are spaced from one another by a distance z1 equal to n1*y where n1 is an integer greater than 1;

wherein the corrugations of the third series of corrugations that are connected to the second deviation portions are spaced from one another by a distance z2 equal to n2*y where n2 is an integer greater than 1 and different from n1; and wherein the angle θ° between the edge and the first direction satisfies the equation:

$$\theta = \tan^{-1}\frac{n2}{n1}.$$

2. The tank according to claim 1, in which each first or second corrugation deviation portion includes:

at least one corner piece portion comprising two flanges respectively parallel to one and the other of the first and second planes, said corner piece portion including a corrugation portion in line with one of the corrugations of the third series of corrugations, from one end to the other of the corner piece portion, along the two flanges; and a junction piece including a bent corrugation portion connecting the corrugation portion of the corner piece portion to one of the corrugations of the first or second series of corrugations.

3. The tank according to claim 1, in which each of the corrugations of the first and second series of corrugations that intersects the edge is extended by one of the first or second corrugation deviation portions.

4. The tank according to claim 1, in which the inter-corrugation distance y between two corrugations of the third series of corrugations satisfies the following formula:

$$\frac{x}{y} = \frac{n1 * n2}{\sqrt{n1^2 + n2^2}}.$$

5. The tank according to claim 1, in which the third direction is perpendicular to the edge.

6. The tank according to claim 1, in which the tank has two end walls connected to each other by walls extending in the longitudinal direction of the tank and in which the first wall forms one of the two end walls and the second wall forms one of the walls extending in the longitudinal direction of the tank.

7. The tank according to claim 1, in which the sealing membrane of the second wall includes a fourth series of corrugations comprising corrugations extending in directions parallel to the edge formed at the intersection between the first and second walls.

8. The tank according to claim 1, wherein some corrugation of the third series are interrupted before the edge and are not in line with any second end of the first or second corrugation deviation portions.

9. A ship for transporting a fluid, the ship including a hull and a tank according to claim 1 disposed in the hull.

10. A method of loading or offloading a ship comprising a tank according to claim 1, in which a fluid is fed through insulated pipes from or to a floating or land storage installation to or from the tank of the ship.

11. A system for transferring a fluid, the system including a ship having a tank according to claim 1, insulated pipes adapted to connect the tank installed in the hull of the ship to a floating or land storage installation and a pump for driving a fluid through the insulated pipes from or to the floating or land storage installation to or from the tank of the ship.

* * * * *